US005112008A

United States Patent [19]

Pahnke et al.

[11] Patent Number: 5,112,008

[45] Date of Patent: May 12, 1992

[54] FIN STABILIZED PROJECTILE HAVING HEAT RESISTANT FINS

[75] Inventors: Klaus-Dieter Pahnke, Solingen; Wilfried Becker, Düsseldorf, both of Fed. Rep. of Germany

[73] Assignee: Rheinmetall GmbH, Düsseldorf, Fed. Rep. of Germany

[21] Appl. No.: 571,678

[22] Filed: Aug. 23, 1990

[30] Foreign Application Priority Data

Aug. 24, 1989 [DE] Fed. Rep. of Germany ..... 3927917

[51] Int. Cl.[5] ..... F42B 10/08

[52] U.S. Cl. ..... 244/3.24; 244/117 A

[58] Field of Search ..... 244/3.24, 117 A, 120, 244/121, 158 A; 102/517

[56] References Cited

U.S. PATENT DOCUMENTS

| | | | |
|---|---|---|---|
| 2,851,950 | 9/1958 | Van Aken et al. | 244/3.24 |
| 3,145,000 | 8/1964 | Mackie | 244/117 A |
| 3,223,034 | 12/1965 | Robertson | 244/324 |
| 3,395,035 | 7/1968 | Strauss | 244/117 A |
| 3,712,566 | 1/1973 | Branen et al. | 244/117 A |
| 4,041,872 | 8/1977 | McCown et al. | 244/158 A |
| 4,098,194 | 7/1978 | Miller et al. | 102/293 |
| 4,151,800 | 5/1979 | Dotts et al. | 244/158 A |
| 4,220,297 | 9/1980 | Harmon, Jr. et al. | 244/117 A |
| 4,392,624 | 7/1983 | Myer | 244/121 |
| 4,693,435 | 9/1987 | Percival et al. | 244/121 |
| 4,706,912 | 11/1987 | Perry | 244/158 A |
| 4,995,573 | 2/1991 | Wallow | 244/3.24 |

FOREIGN PATENT DOCUMENTS

| | | | |
|---|---|---|---|
| 0249525 | 12/1987 | European Pat. Off. . | |
| 316575 | 12/1919 | Fed. Rep. of Germany . | |
| 1145963 | 3/1963 | Fed. Rep. of Germany . | |
| 1061958 | 4/1954 | France . | |
| 1394264 | 2/1965 | France | 244/3.24 |
| WO88/07169 | 9/1988 | PCT Int'l Appl. . | |
| 514085 | 10/1939 | United Kingdom | 244/3.24 |
| 1602338 | 11/1981 | United Kingdom . | |

*Primary Examiner*—Michael J. Carone

*Attorney, Agent, or Firm*—Spencer & Frank

[57] ABSTRACT

A fin stabilized projectile in which measures are taken for increasing the thermal resistance of its guide fins against the uncontrollable danger of burning or melting due to overheating of the material as a result of air friction during the flight of the projectile. Each guide fin is composed, at least in the region of its leading edge of a heat resistant fiber material or a heat resistant composite fiber material. The fins may be composed entirely of the heat resistant material or the leading edges of the fins, the leading and outer edges of the fins, or the entire front fin portion may be configured as a strip of the fiber material in front of and fastened to a metal body member comprising the remainder of the respective guide fin. Moreover, the connecting region between any such strip and the metal body member is preferably configured with a sloped, and thus as a contact area which has a larger surface area. The strip is glued, riveted and/or screwed to the body member in the connection region. Furthermore, the fins are attached to the projectile by any one of the disclosed embodiments.

20 Claims, 3 Drawing Sheets

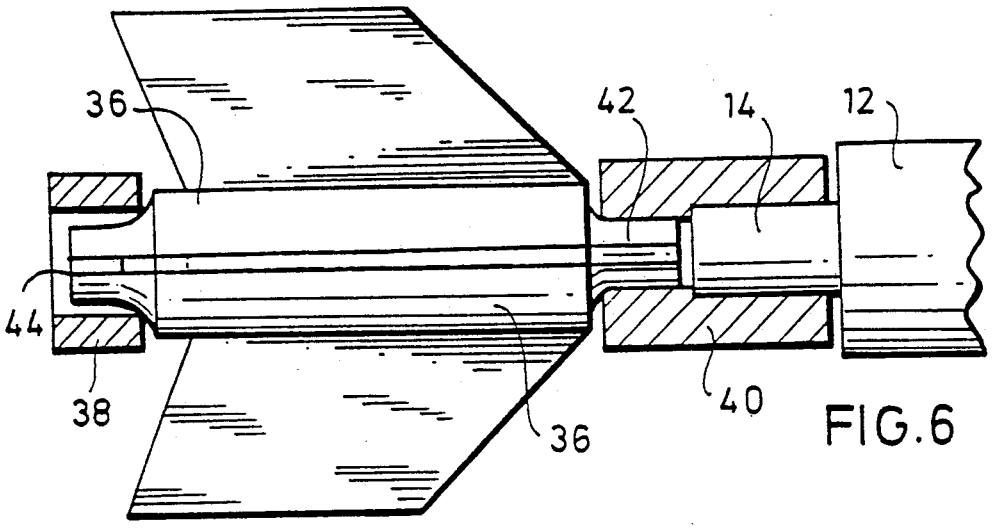
FIG.6
FIG.7
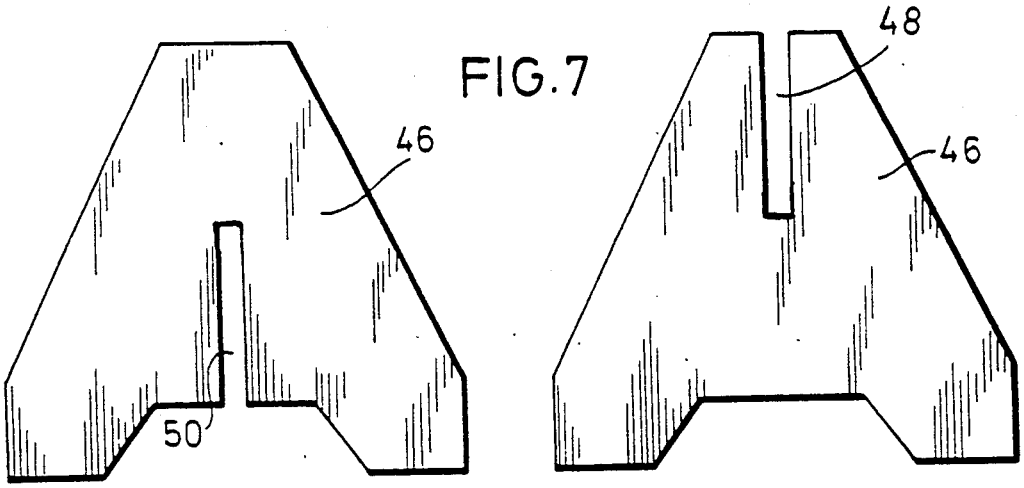
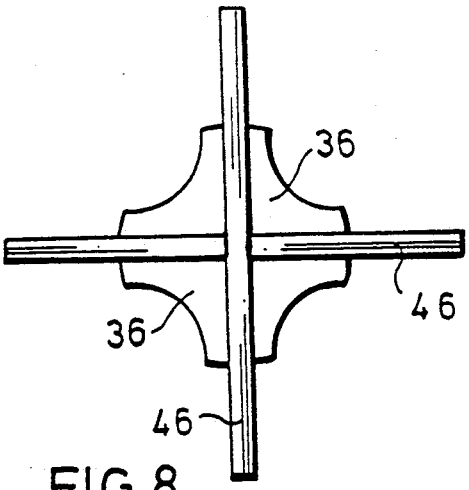
FIG.8
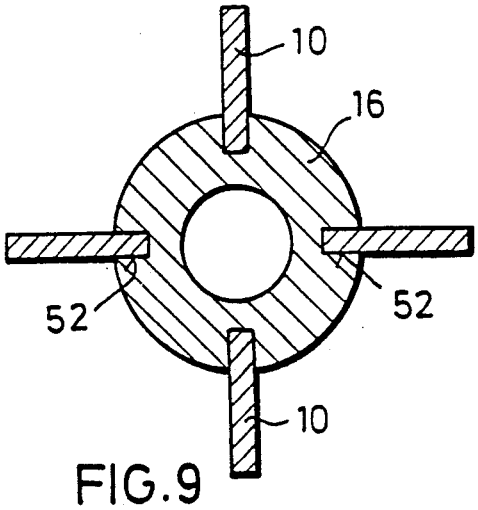
FIG.9

FIN STABILIZED PROJECTILE HAVING HEAT RESISTANT FINS

BACKGROUND OF THE INVENTION

The present invention relates to a fin stabilized projectile, particularly a kinetic energy projectile having a great longitudinal extent, in which measures are taken to increase the thermal resistivity of the guide fins.

In fin stabilized projectiles fired over great distances at high velocities of, for example, 1500 m/s, friction with the air acting particularly on the leading edges of the fins creates high thermal stresses. Particularly in guide fins made of an aluminum alloy, this may cause the leading and outer edges of these guide fins to begin to melt away in an uncontrollable manner.

Federal Republic of Germany published patent application No. 1,145,963 discloses, as a measure of thermal protection against air friction and overheating of guide fins made of aluminum, to provide such guide fins with a coating of a melamine or a polyamide lacquer or a similar lacquer.

Moreover, U.S. Pat. No. 4,098,194 discloses a fin stabilized high velocity projectile in which aluminum components such as, for example, the guide fins or the ballistic hood, are provided with a hard coating protective layer in order to increase their thermal resistivity. This protective layer is to be applied by the electrolytic deposition of an alkali metal silicate from an aqueous solution.

However, in projectiles whose guide fins are covered by a thin thermal protection layer, it may happen nevertheless that the liquidus temperature of the metal alloy of the guide fins is exceeded in some regions in which case, although the thermal protection layer may remain intact at the front end, the hydrodynamic pressure of the liquid metal may cause the protective layer to break open at the rear and permit the liquid metal to flow out. Tests have shown the breaking-up effect of the protection layer.

Although steel guide machanisms employing solid steel fins have the necessary thermal resistivity, their great weight in the projectile results a high percentage of dead weight which is ineffective in the target.

SUMMARY OF THE INVENTION

It is an object of the present invention to overcome the above mentioned drawbacks and dangers for a fin stabilized projectile and, without increasing the mass of the guide mechanism, provide an easily realized thermal protection for guide fins that are stressed by high temperatures.

The above object is generally achieved according to the present invention by a fin stabilized projectile including a projectile body and a stabilizing unit, including a plurality of guide fins, disposed at and fastened to the tail of the projectile body, and wherein each guide fin is composed, at least in the region of its leading edge, of one of a heat resistant fiber material and a heat resistant composite fiber material, whereby the thermal resistance of the guide fins against the danger of burning or melting due to overheating of the material as a result of friction with the air during the flight of the projectile is increased.

Due to the fact that each guide fin, particularly in the region of its front edge, is at least in part composed of a heat resistant material, that is, a heat resistant fiber material or a heat resistant composite fiber material, thermal overheating of the guide fins is reliably excluded since the fiber material has a considerably lower coefficient of thermal conductivity than the aluminum alloys or steels customarily employed for guide fins.

As a feature of the invention it is provided that not only the leading edge but also the outer edges of the fins and/or the entire front portion of the fin, that is, the front half of the fin ahead of a smaller metal body member of the respective guide fin, is composed of the composite fiber material.

Suitable composite fiber materials are, for example, ceramic materials which are reinforced with carbon or glass fibers and which include components of aluminum oxide, zirconium oxide, silicon carbide, silicon nitride and/or the like, such as, for example, alumina and/or silicic acid components, or titanium aluminides reinforced with silicon carbide fibers as they are known in the space travel art. Preferably, the fibers in the matrix material have a unidirectional orientation.

The high temperature resistant materials at the leading and outer edges of the fins protect the remaining metal portion of the fin against damaging thermal influences. The fire resistance of these actually brittle materials is realized by the embedment of the carbon/glass fibers. The advantages of the ceramic composite fiber materials lie in their high mechanical strength up to temperatures of about 1700° C., high wear resistance, low heat retention capacity and a low coefficient of friction. Suitable fiber materials, also with the addition of binders, are, for example, precision shaped components made of ceramic fibers (e.g. alumina/ silicic acid fibers) in the form of double needled felt (needle felt). The needling of the fibers (up to a length of 20 cm) produces high mechanical strength with positive thermal characteristics.

Fastening the composite fiber material for the front end to the body portion of the guide fin may preferably be effected by screwing, riveting and/or gluing.

The present invention will be described below in greater detail with reference to embodiments thereof that are illustrated in the drawing figures.

BRIEF DESCRIPTION OF THE DRAWINGS

FIG. 6 is a side view of the fastening device of FIG. 5.

FIG. 7 shows two one-piece fin pairs according to the invention.

FIG. 8 is a schematic end view showing the pair of guide fin members of FIG. 7 held by a plurality of individual clamping members.

FIG. 9 is a cross-sectional view of a further fastening device for individual guide fins.

DETAILED DESCRIPTION OF THE PREFERRED EMBODIMENTS

Figure 1:
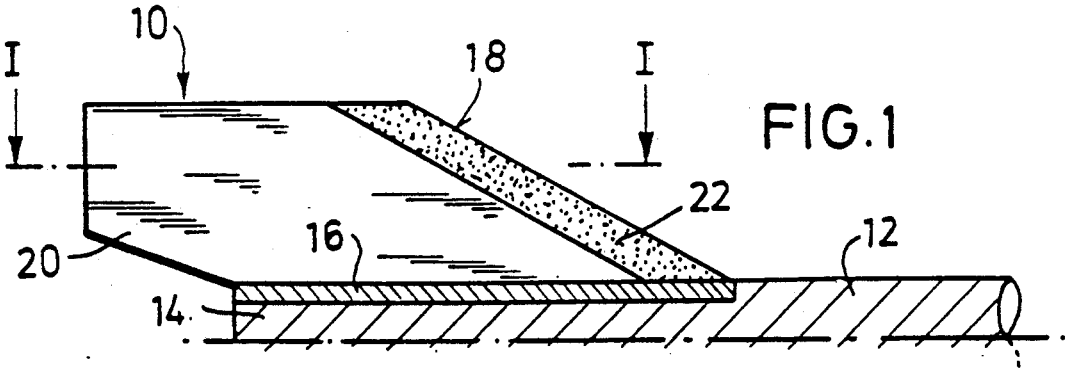
FIG. 1 is a side view of one embodiment of a guide fin according to the invention, disposed on a projection shown in partial longitudinal section.

Referring now to FIG. 1, there is shown a guide fin 10 of a guide fin (fin stabilization unit) mechanism shown only in part for a sub-caliber kinetic energy projectile (penetrator) having a large length to diameter ratio. Such fin guide mechanisms generally include four, five or six guide fins 10. The guide mechanism includes a guide mechanism casing or cylindrical member 16 to which the guide fins 10 are connected and by means of which the fin stabilization unit is fastened to a somewhat smaller diameter fastening stub 14 on the rear or tail of the projectile body 12. Guide mechanism casing 16 may, for example, be glued, welded, soldered and/or screwed to the fastening stub 14. Guide fin 10 is composed of a metal body member 20, e.g., of steel or an aluminum alloy, with a strip 22 of a suitable heat resistant fiber or composite fiber material fastened thereto along its leading edge and forming the leading fin edge 18 of the guide fin 10.

Figure 1A:
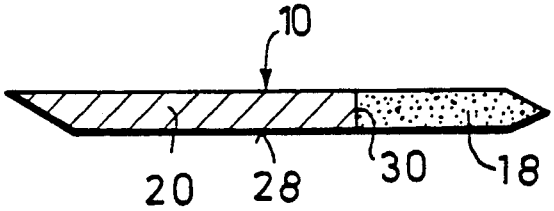
FIG. 1*a* is a cross-sectional view of a guide fin according to the invention in the direction I—I of FIG. 1.

As shown in FIG. 1*a*, the metal body member 20 and the fin member or strip 22 forming the leading fin edge 18 have a blunt contact face 30 which is oriented perpendicularly to the outer surface 28 of the fin 10 and by which the two fin members 20 and 22 are connected preferably glued, to one another.

Figure 1B:
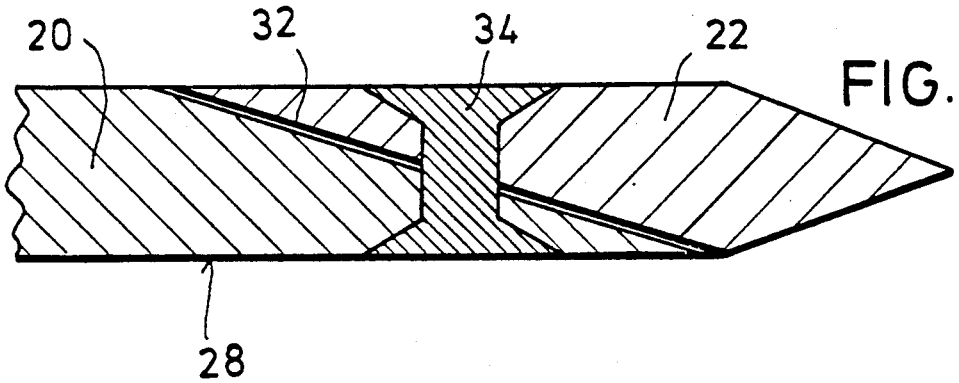
FIG. 1*b* is a cross-sectional view of another arrangement of a guide fin according to the invention.

FIG. 1*b* shows another embodiment or arrangement for connecting the body member 20 and the fin member 22 of fiber material to one another. According to this embodiment, the members 20 and 22 abut over a contact face 32 extending obliquely to the outer face 28 of the fin and are connected together by one or several rivets 34 as illustrated. However, the connection of the two members 20 and 22 at the oblique contact surface 32 could also be effected by soldering, screwing and/or gluing. To enlarge the contact surface between the two members, the contact surfaces could be configured in a different form, for example, in a dovetail shape or as an elongate groove and spline arrangement.

Figure 2:
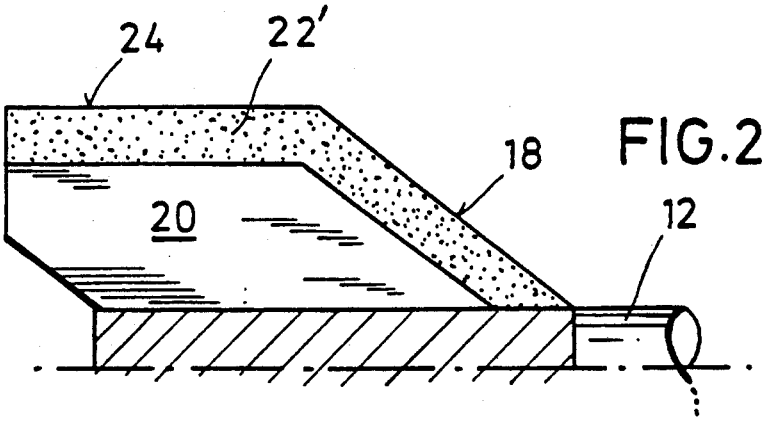
FIGS. 2, 3 and 4 are side views of further embodiments of the guide fin according to the invention showing different-size regions of a guide fin made of the composite fiber material.

FIG. 2 shows a preferred embodiment in which the guide fin 10 is composed of a smaller metal body member 20 and a strip 22' of fiber or composite fiber material which is fastened to the body member and is configured as a leading fin edge 18 and as an outer fin edge 24. With this arrangement, the outer fin edge 24 is thermally protected as well as the leading edge 18.

Figure 3:
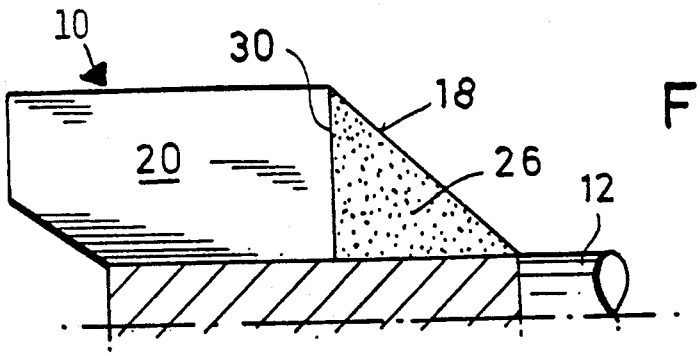

An alternative preferred embodiment is shown in FIG. 3. As shown in this embodiment the guide fin 10 includes a front fin member 26 which forms the entire front portion of the fin, i.e., the entire fin portion contains the leading edge, and which is composed entirely of the fiber or composite fiber material. This member 26 is then followed by a reduced or smaller area metal body member 20 forming the remainder of the guide fin 10.

Figure 4:
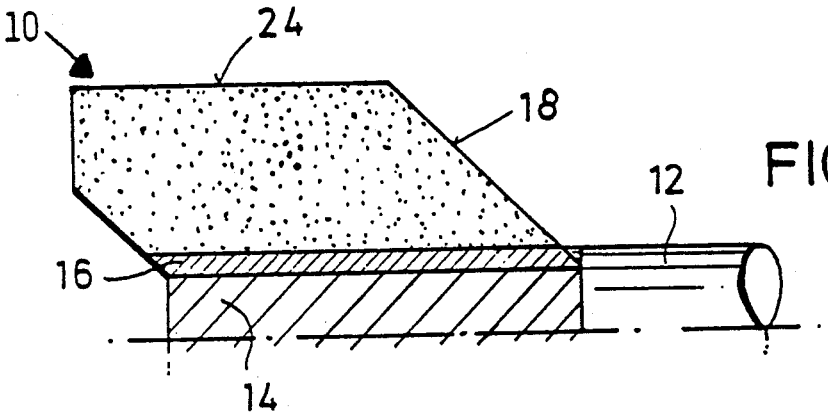

As shown in FIG. 4, it may also be advisable for guide fin 10 to be composed entirely of the heat resistant fiber material and to be fastened to the rear of the projectile body 12 by means of a suitable fastening device. Such an arrangement has the advantage that the composite fiber material has a comparatively lower density and thus reduces the dead weight percentage of the guide mechanism for the respective penetrator.

Figure 5:
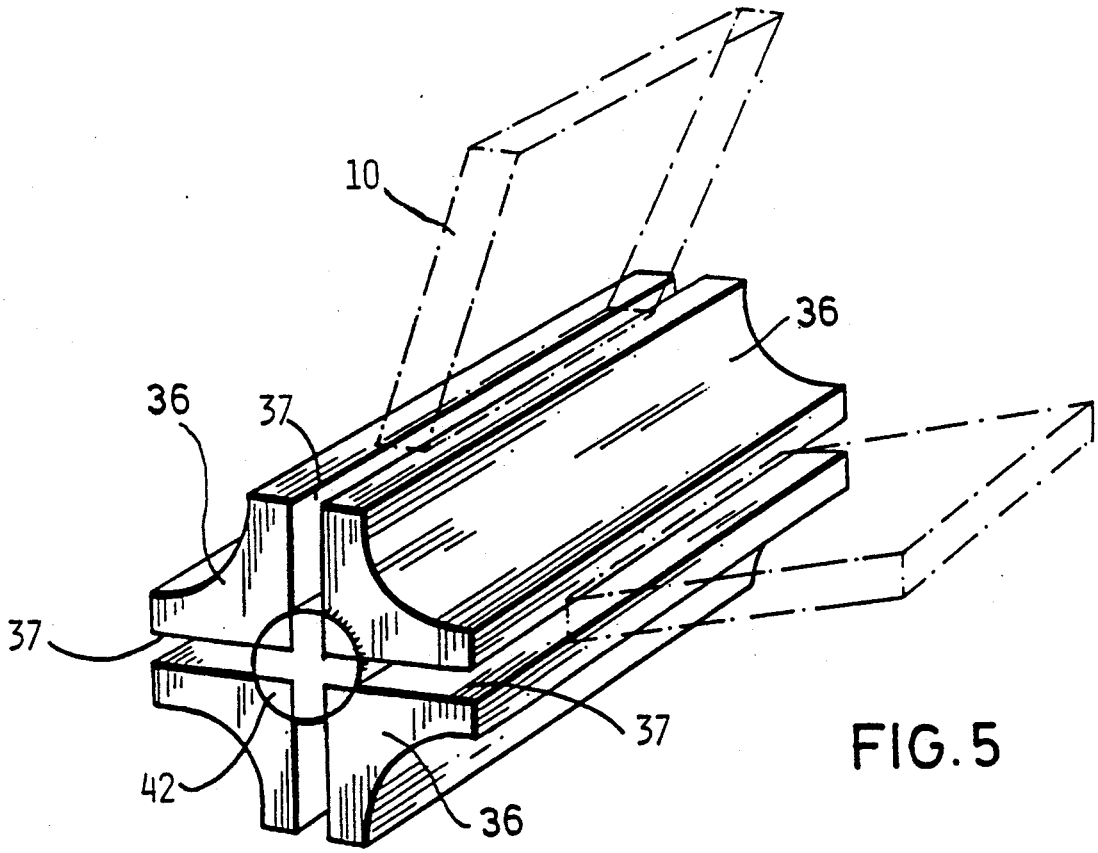
FIG. 5 is a schematic perspective view of a fastening device according to the invention for fastening individual guide fins or pairs of fins.

Instead of the conventional guide mechanism casing a suitable fastening device for individual guide fins 10, particularly if made entirely of fiber or composite fiber material, is shown in FIGS. 5 and 6. The fastening device is here composed of a number of clamping elements 36 corresponding to the number of fins 10 and having an angular cross section. With four fins 10, as shown, four clamping elements 36 having an angular cross section forming a 90° angle are provided so that each fin can be clamped so that each fin 10 will be clamped between facing radially extending surfaces 37 of an adjacent pair of elements 36. Each clamping element includes a forwardly extending stub axle portion 42 and a rearwardly extending stub axle portion 44 such that when the clamping elements 36 are assembled adjacent one another, a short stub axle extends from each end. The clamping elements 36 are held tightened radially against one another by means of a clamping ring 38 which engages the stub axle formed by segments 44 at the rear and by a clamping ring 40 which engages the stub axle formed by segments 44 at the front in a known manner, for example by corresponding threads.

As shown in FIG. 6, the front clamping ring 40 is extended and simultaneously configured as a connecting arrangement for connecting the guide fin assembly of fins 10 and elements 36 to the projectile body 12. For this purpose, the front clamping ring 40 is provided with an internal thread at its end opposite the fins 10 and is screwed onto a shortened threaded stub 14 at the rear of the projectile body 12.

According to a particular feature of the invention, a fin construction which is particularly suited for the clamping arrangement of FIGS. 5 and 6 is shown in FIG. 7 wherein two oppositely disposed guide fins 10 in a four-fin guide mechanism are made of one piece of heat resistant material to provide a one-piece fin pair 46. In order to permit the flush insertion of one or several one-piece fin pairs 46, i.e. so that they will be properly aligned in the guide assembly, the fins pairs 46 are each provided with a corresponding slot-like recess 48 or 50 along its longitudinal axis and extending alternatingly from the front and from the rear of the respective one-piece fin pair 46. The relative lengths of the two slots 48, 50 of a pair of one-piece fin pairs 46 should be such that when engaged the fin pairs 46 are properly aligned and preferably extend over one half of the length of a fin pair 46 along its longitudinal axis.

FIG. 8 is a schematic end view showing the guide mechanism of FIGS. 5 and 6 composed of four individual angled clamping elements 36 for a pair of one-piece guide fin pairs 46 as shown in FIG. 7. However, as shown in FIG. 9, individual guide fins 10 may also be fastened on a somewhat more solid guide mechanism casing 16, for example of steel or aluminum, in that they are inserted into respective longitudinally extending grooves 52 provided on the circumferential surface of the casing 16. This provides the guide fins 10 with a better lateral support, particularly if the guide fins are provided at their front and rear edges, respectively, with corresponding slopes (inclined surfaces) for generating compensatory rotation of the projectile body.

If the guide fins 10 are made entirely of fiber material, they are advisably glued into the longitudinal grooves 52. If guide fins 10 are composed only partially of fiber material and are provided with an additional metal body member 20 at the rear, the latter is preferably welded or soldered to guide mechanism casing 16.

The configurations of guide fins according to the invention eliminate, in a simple and reliable manner, the problem of uncontrollable melting or burning away of the fins.

The invention now being fully described, it will be apparent to one of ordinary skill in the art that many changes and modifications can be made thereto without departing from the spirit or scope of the invention as set forth herein.

What is claimed is:

1. A fin stabilized projectile comprising: a projectile body; a stabilizing unit, including a plurality of guide fins, disposed at and fastened to the tail of said projectile body; and wherein each said guide fin is composed, at least in the region of its leading edge, of a heat resistant composite fiber material which is one of a ceramic material reinforced with carbon or glass fibers, an a titanium aluminide reinforced with silicon carbide fibers, whereby the thermal resistance of the guide fins against the danger of burning or melting due to overheating of the material as a result of friction with the air during the flight of the projectile is increased.

2. A projectile as defined in claim 1 wherein each of said guide fins is composed of a metal body member and a further member of said heat resistant material fastened to said metal member and extending at least along and forming the leading edge of the respective said guide fin.

3. A projectile as defined in claim 2 wherein said further member comprises a strip of said heat resistant material extending along said leading edge of said metal member.

4. A projectile as defined in claim 3 wherein said strip of heat resistant material additionally extends along and forms the outer edge of the respective said guide fin.

5. A projectile as defined in claim 2 wherein each said guide fin includes a front fin body member formed entirely of said heat resistant material and a following metal fin body member fastened to said front member of the respective said guide fin.

6. A projectile as defined in claim 2 wherein said metal body member and said further member of said heat resistant material have respective abutting contact surfaces extending perpendicularly to an exterior surface of the respective said guide fin, and means for fastening said contact surfaces together.

7. A projectile as defined in claim 2 wherein: said metal body member and said further member of heat resistant material have respective abutting contact surfaces which extend obliquely to the outer faces of the respective said guide and further comprising means for fastening said abutting contact surfaces together.

8. A projectile as defined in claim 7 wherein said means for fastening comprises one of glue, at least one rivet, and at least one screw.

9. A projectile as defined in claim 1 wherein each said guide fin comprises a metal body which is smaller than the respective guide fin and a strip of said heat resistant material fastened to said metal body portion along its leading and outer edges to form the leading and outer edges of the respective said guide fin.

10. A projectile as defined in claim 1 wherein: each of said guide fins is composed entirely of said heat resistant material; and said stabilizing unit includes means for fastening said guide fins to the tail of said projectile body.

11. A projectile as defined in claim 10 wherein: said means for fastening comprises a cylindrical member having a plurality of longitudinally extending slots in its peripheral surface; and each said guide fin extends into a respective one of said slots and is fastened thereto.

12. A projectile as defined in claim 1 wherein: said stabilizing unit includes a cylindrical member fastened to the tail of said projectile body and having a plurality of longitudinally extending slots in its peripheral surface; and each said guide fin extends into a respective one of said slots and is fastened therein.

13. In a fin stabilized projectile including a projectile body and a stabilizing unit, including a plurality of guide fins and means for fastening the guide fins to the tail of said projectile body, disposed at and fastened to the tail of said projectile body; the improvement wherein: each said guide fin is composed entirely of one of a heat resistant fiber material and a heat resistant composite fiber material, whereby the thermal resistance of the guide fins against the danger of burning or melting due to overheating of the material as a result of friction with the air during the flight of the projectile is increased; said means for fastening includes a number of clamping elements corresponding to the number of said guide fins, with each of said clamping elements having an angular cross section, and means, including first and second clamping rings disposed respectively at the front and at the rear of the said plurality of clamping elements, for radially clamping said clamping elements to one another; and said first clamping ring is configured to simultaneously form a connecting means between said stabilizing unit and said projectile body.

14. A projectile as defined in claim 13 wherein: each projectile has four of said guide fins; each pair of oppositely disposed said guide fins is made of one pair of said material to form a one-piece pair of fins; and, each said one-piece pair of fins is provided with a slot-like recess extending partially along its longitudinal axis which engages in a corresponding said slot-like recess in a further of said one-piece pair of fins such that said fins can be aligned.

15. In a fin stabilized projectile including a projectile body and a stabilizing unit, including four guide fins and means for fastening the guide fins to the tail of said projectile body, disposed at and fastened to the tail of said projectile body; the improvement wherein: each said guide fin is composed entirely of one of a heat resistant fiber material and a heat resistant composite fiber material, whereby the thermal resistance of the guide fins against the danger of burning or melting due to overheating of the material as a result of friction with the air during the flight of the projectile is increased; each pair of oppositely disposed said guide fins is made of one piece of said material to form a one-piece pair of fins; and, each said one-piece pair of fins is provided with a slot-like recess extending partially along its longitudinal axis which engages in a corresponding said slot-like recess in a further of said one-piece pair of fins such that said fins can be aligned.

16. In a fin stabilized projectile including a projectile body and a stabilizing unit, including a plurality of guide fins, disposed at and fastened to the tail of said projectile body; the improvement wherein: each said guide fin is composed, at least in the region of its leading edge, of one of a heat resistant fiber material and a heat resistant composite fiber material, whereby the thermal resistance of the guide fins against the danger of burning or melting due to overheating of the material as a result of friction with the air during the flight of the projectile is increased; and said stabilizing unit includes a number of clamping elements corresponding to the number of said guide fins, with each of said clamping elements having an angular cross section, and means, including first and second clamping rings disposed respectively at the front and at the rear of the said plurality of clamping elements, for radially clamping said clamping elements to one another, with a respective one of said guide fins being disposed between and clamped by facing surfaces of each pair of adjacent said clamping elements, and with said first clamping ring being configured to simultaneously form a connecting means between said stabilizing unit and said projectile body.

17. A projectile as defined in claim 16 wherein said heat resistant composite fiber material is one of a ceramic material reinforced with carbon or glass fibers, and a titanium aluminide reinforced with silicon carbide fibers.

18. A projectile as defined in claim 16 wherein said heat resistant fiber material is a felt of ceramic fiber with a binder.

19. A projectile as defined in claim 16 wherein: said projectile has four of said guide fins; each pair of oppositely disposed said guide fins is formed as a one-piece pair of fins; and, each said one-piece pair of fins is provided with a slot-like recess extending partially along its longitudinal axis and engaging in a corresponding said slot-like recess in a further of said one-piece pair of fins such that said fins can be aligned longitudinally.

20. A projectile as defined in claim 16 wherein: each of said guide fins is composed entirely of said heat resistant material.

* * * * *